US005224845A

United States Patent [19]

Mangyo et al.

[11] Patent Number: 5,224,845

[45] Date of Patent: Jul. 6, 1993

[54] REFRIGERANT CIRCULATION PUMP FOR AIR-CONDITIONER

[75] Inventors: Masao Mangyo, Fujisawa; Makoto Yamamuro, Yokohama, both of Japan

[73] Assignee: Matsushita Refrigeration Company, Osaka, Japan

[21] Appl. No.: 828,840

[22] Filed: Jan. 31, 1992

[51] Int. Cl.[5] ..... F04B 35/04

[52] U.S. Cl. ..... 417/423.13; 184/6.16

[58] Field of Search ..... 417/423.13, 372; 184/6.16

[56] References Cited

U.S. PATENT DOCUMENTS

| | | | |
|---|---|---|---|
| 2,031,080 | 2/1936 | Deventer | 417/423.13 |
| 3,521,978 | 7/1970 | Enemark | 417/423.13 |
| 3,565,553 | 2/1971 | Rinehart et al. | 417/423.13 |
| 5,060,759 | 10/1991 | Dussaurd et al. | 184/6.16 |

FOREIGN PATENT DOCUMENTS

| | | | |
|---|---|---|---|
| 1159637 | 6/1958 | France | 184/6.16 |

*Primary Examiner*—Richard A. Bertsch
*Assistant Examiner*—Charles G. Freay
*Attorney, Agent, or Firm*—Lowe, Price, LeBlanc & Becker

[57] ABSTRACT

A refrigerant circulation pump for circulating a liquid refrigerant through an air-conditioner has a small lubrication hole extending through a bearing by means of which a shaft for driving a compressor unit of the pump is rotatably supported. The lubrication hole communicates at one of its opposite ends with a compression chamber of the compressor unit, the other of the opposite ends communicating with a friction point between the shaft and the bearing. While the pump is operating, a part of the liquid refrigerant is fed under pressure from the compression chamber to the friction point between the shaft and the bearing, thereby lubricating the friction point. With this lubrication, the pump is able to operate reliably for a prolonged period of time without causing wear of the shaft and the bearing.

4 Claims, 3 Drawing Sheets

REFRIGERANT CIRCULATION PUMP FOR AIR-CONDITIONER

BACKGROUND OF THE INVENTION

1. Field of the Invention

The present invention relates to a pump used in an air-conditioner for circulating a liquid refrigerant through a refrigerating system of the air-conditioner.

2. Description of the Prior Art

In the refrigeration and air-conditioning industry, there has recently been proposed an air-conditioner equipped with a pump for circulating a liquid refrigerant through a refrigeration system of the air-conditioner.

The refrigerant circulation pump of the proposed air-conditioner is designated by 1 such as shown here in FIGS. 4 through 7. The pump 1 includes a closed container 2 which is composed of a tubular central shell body 3, a first end shell 5 closing one end 3*a* of the shell body 3 and provided with an electrode assembly 4 of the so-called "hermetic terminal" type, and a second end shell 8 closing an opposite end of the shell body 3 and provided with a discharge pipe 6 (FIG. 7) and an intake pipe 7. The closed container 2 houses therein an electric motor unit 11 composed of a stator 9 and a rotor 10, a shaft 13 rotatably driven by the rotor 10 and having an eccentric portion 12, a cylinder 16 having defined therein a compression chamber 14 and an intake hole 15 and a discharge hole 19 that communicate with the compression chamber 14, and a roller 17 firmly fitted over the eccentric portion 12 for co-rotation therewith and slidably movable along an inside surface of the compression chamber 14 as the eccentric portion 12 of the shaft 13 rotates within the compression chamber 14. Numeral 18 (FIG. 5) is a vane reciprocally movable in a radial direction within a vane groove 20 extending between the intake hole 15 and the discharge hole 19. The vane 18 is normally urged against the roller 17 by a spring 21. A bearing 22 is disposed adjacent to the cylinder 16 and rotatably supports an intermediate portion 13*a* of the shaft 13. The bearing 22 has an outer peripheral surface 22*a* firmly fitted with an inside surface of the closed container 2. The intake pipe 7 communicates with the inside of the closed container 2 and has an end 7*a* welded as at 23 to the second end shell 8. The discharge pipe 6 extends through the second end shell 8 and has an end 6*a* press-fitted in the discharge hole 19 in the cylinder 16. A liquid refrigerant 24 is filled in the closed container 2. The interior of the closed container 2 is communicated with the discharge pipe 6 through a pressure equalizing hole 25 (FIG. 7) formed in the discharge pipe 6.

With the foregoing construction, when the motor unit 11 is energized via the electrode assembly 4 to rotate the shaft 3 and the rotor 10, a liquid refrigerant returning from an air-conditioning system (not shown) is introduce through the intake pipe 7 into the interior of the closed container 2 where the refrigerant is stirred and then drawn from the intake hole 15 into the compression chamber 14 in the cylinder 16. As the roller 17 rolls on and along the inside surface of the compression chamber 14, the refrigerant is gradually compressed within the compression chamber 14 and then discharged from the compression chamber 14 through the discharge hole 19. Thereafter, the compressed refrigerant is delivered to an air-conditioning system (not shown) via the discharge pipe 6. As the compressed refrigerant flows through the discharge pipe 6, a very small quantity of liquid refrigerant leaks out from the pressure equalizing hole 26 into the enclosed container 2 so as to keep the interior of the enclosed container 2 at a high pressure.

According to the known refrigerant circulation pump of the foregoing construction, the liquid refrigerant lubricates the shaft 13 and the bearing 22. However, as the level of the liquid refrigerant becomes low, lubrication of the shaft 13 and the bearing 22 is performed insufficiently with the result that the shaft 13 and the bearing 22 wear out severely. The service life of the known refrigerant circulation pump is, therefore, relatively short.

SUMMARY OF THE INVENTION

With the foregoing drawbacks of the prior art in view, it is an object of the present invention to provide a refrigerant circulation pump which is able to operate reliably for a prolonged period of time without causing wear of a shaft and a bearing of the pump.

A refrigerant circulation pump of the present invention comprises a closed container in which an electric motor unit and a compressor unit that are disposed. The compressor unit has a cylinder. A shaft driven by the electric motor unit is rotatably supported by a bearing, The bearing and the cylinder jointly define therebetween a compression chamber in which a liquid refrigerant is compressed. The compression chamber is communicated with a friction point between the shaft and the bearing by a small lubrication hole extending through the bearing. With the lubrication hole thus provided, the friction point is lubricated with the liquid refrigerant supplied from the compression chamber under pressure.

Preferably, the lubrication hole communicates at one end with a discharge hole of the compression chamber and, at an opposite end, with the friction point between the shaft and the bearing.

With this construction, a part of the liquid refrigerant which is compressed within the compression chamber is supplied via the small hole to the friction point between the shaft and the bearing, thereby lubricating the friction point. With this lubrication, the refrigerant circulation pump is able to operate reliably for a long period of time without causing wear of the shaft and the bearing.

The above and other objects, features and advantages of the present invention will become more apparent from the following description when making reference to the detailed description and the accompanying sheets of drawings in which preferred structural embodiments incorporating the principles of the present invention are shown by way of illustrative examples.

DETAILED DESCRIPTION OF THE INVENTION

The present invention will be described below in greater detail with reference to certain preferred embodiments illustrated in the accompanying drawings.

Figure 1:
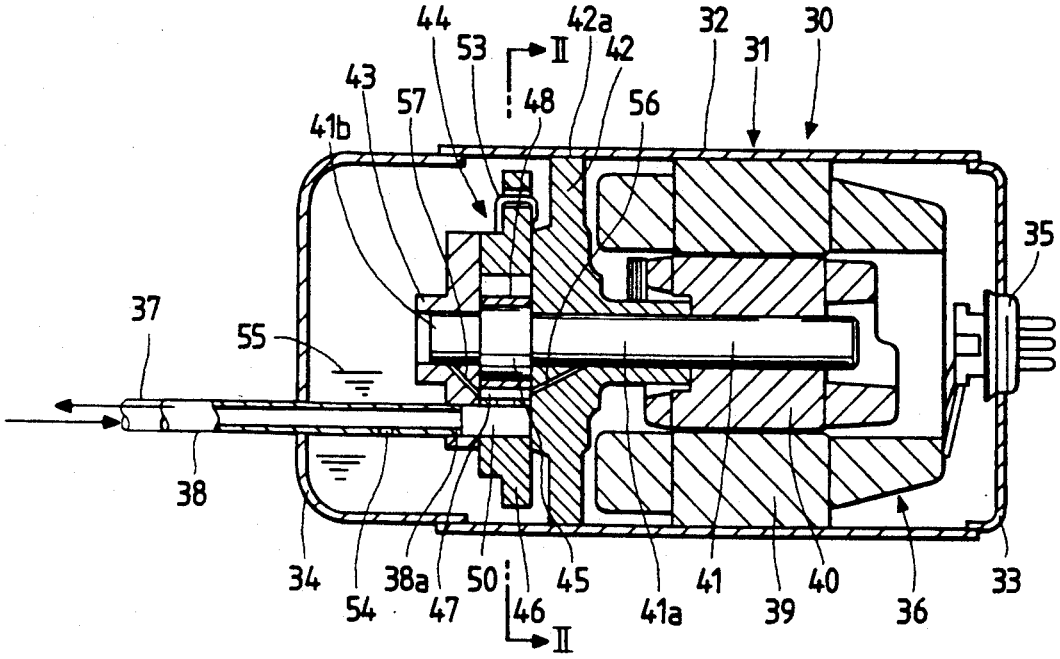
FIG. 1 is a cross-sectional view of a refrigerant circulation pump according to one embodiment of the present invention.

FIG. 1 shows, in cross section, a refrigerant circulation pump 30 according to a first embodiment of this invention. The pump 30 includes a closed container or shell 31 which is composed of a tubular central shell body 32, a cup-shaped first end shell 33 closing one of opposite ends of the shell body 32, and a cup-shaped second end shell 34 closing the other end of the shell body 32. The first end shell 33 is provided with an electrode assembly 35 of the so-called "hermetic terminal" type to which electricity is applied to energize an electric motor unit 36 of the pump 30. The second end shell 34 is provided with an intake pipe 37 and a discharge pipe 38.

The electric motor unit 36 is mounted in the closed container 32 and includes a stator 39 secured to the shell body 32, and a rotor 40 rotatably disposed in the stator 39. A shaft 41 is rotatably supported by a pair of spaced bearings 42 and 43 and driven by the rotor 40 to operate a compressor unit 44 received within the closed container 31. The shaft 41 has an eccentric portion 45 disposed between the bearings 42, 43. The bearing 42 rotatably support an intermediate portion 41*a* of the shaft 41 and has an outer peripheral surface 42*a* firmly fitted with an inner peripheral surface of the closed container 31. The bearing 43 rotatably supports an end portion 41*b* of the shaft 41 projecting outwardly from the eccentric portion 45.

The compressor unit 44 includes a cylinder 46 disposed between the bearings 42 and 43 in concentrical relation to the shaft 41. The cylinder 46 is secured at one end with an end of the bearing 42, and the bearing 43 is secured to the opposite end of the cylinder 46. The cylinder 46 and the bearings 42, 43 jointly define therebetween a compression chamber 47 in which the eccentric portion 45 of the shaft 41 is received. A ring-shaped roller 48 is firmly fitted over the eccentric portion 45 so that the roller 48 rolls on and along the inside surface of the compression chamber 47 as the eccentric portion 45 of the shaft 41 rotates. The compression chamber 47 communicates with an inlet hole 49 and a discharge hole 50 that are formed in the cylinder 46. The inlet hole 49 and the discharge hole 50 are separated from one another by a vane 51 which is slidably received in a radial vane groove 52 and normally urged against an outer peripheral surface of the roller 48 by means of a spring 53.

Figure 4:
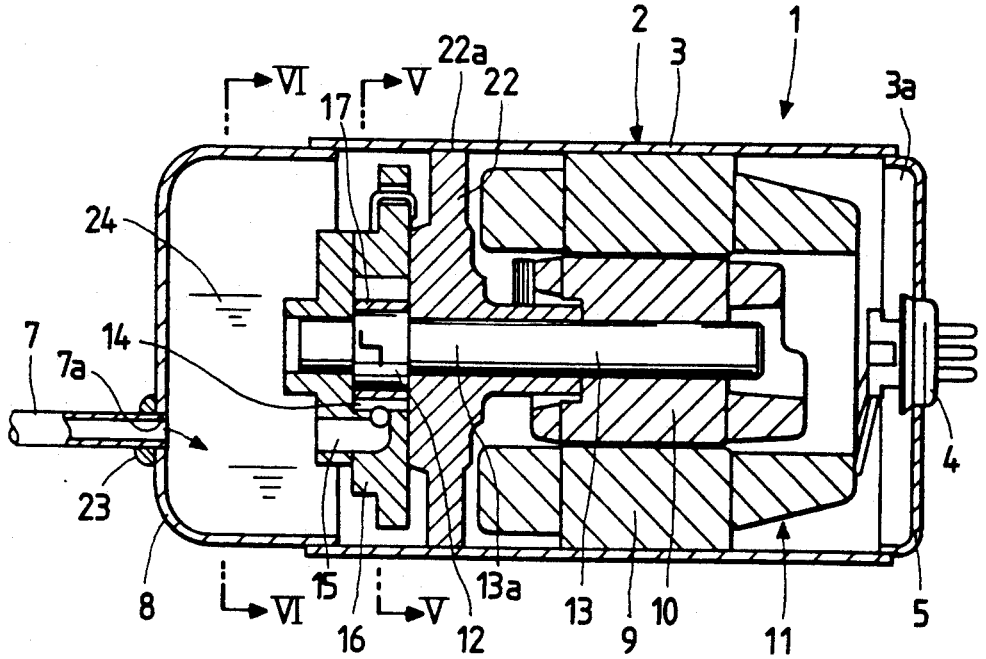
FIG. 4 PRIOR ART
FIG. 4 is a cross-sectional view of a conventional refrigerant circulation pump.
Figure 5:
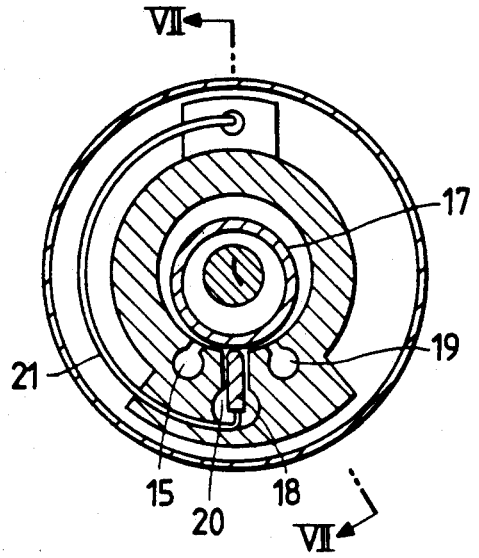
FIG. 5 PRIOR ART
FIG. 5 is a cross-sectional view taken along line V—V of FIG. 4.
Figure 6:
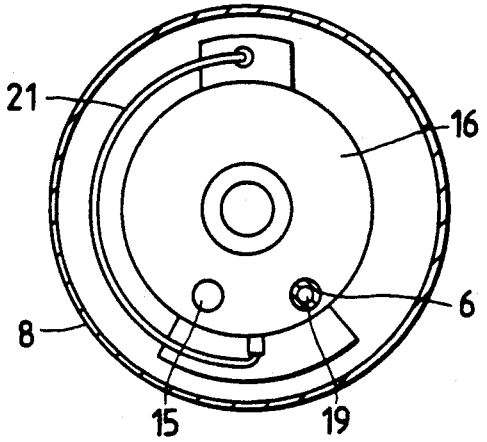
FIG. 6 PRIOR ART
FIG. 6 is a cross-sectional view taken along line VI—VI of FIG. 4.
Figure 7:
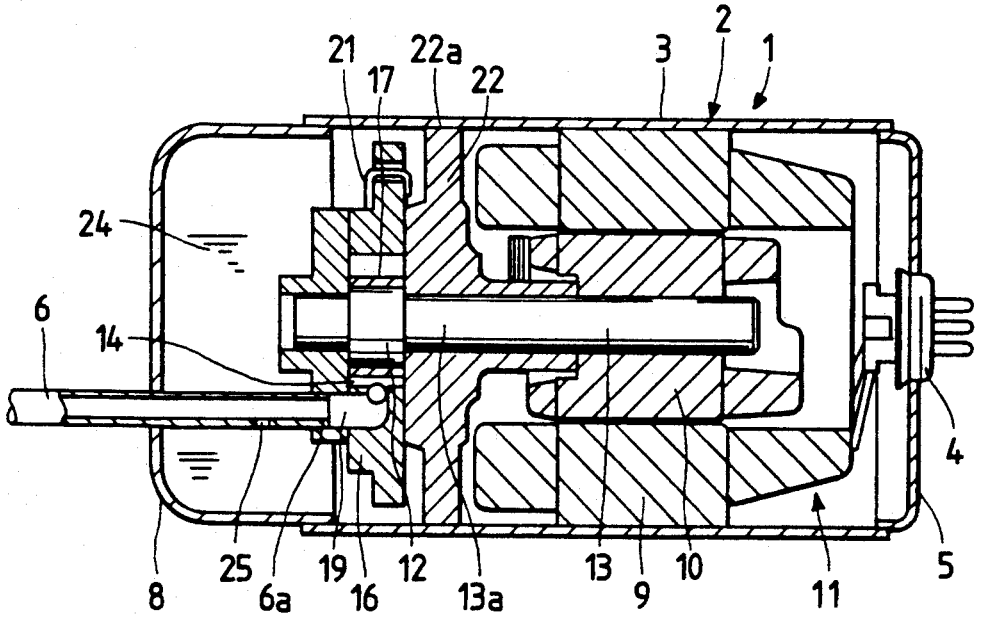
FIG. 7 PRIOR ART
FIG. 7 is a cross-sectional view taken along line VII—VII of FIG. 5.

The intake pipe 37 has one end welded to the second end shell 34 and communicates with the interior of the closed container 31 in the same manner as the intake pipe 7 of the conventional pump shown in FIG. 4. The discharge pipe 38 extends through the second end shell 34 and has an end 38*a* press-fitted in the discharge hole 50 in the cylinder 46. The discharge pipe 38 has a pressure equalizing hole 54 of a small diameter interconnecting the interior of the closed container 31 and the inside of the discharge pipe 38 so as to keep the interior of the closed container 31 at a high pressure. A liquid refrigerant 55 is filled in the closed container 31.

The bearing 42 has a first lubrication hole 56 which communicates, at one of its opposite ends, with the compression chamber 47 and, at the other end, with a friction point between the intermediate portion 41*a* of the shaft 41 and the bearing 42 for a purpose described below. More specifically, the one end of the first lubrication hole 56 opens to the compression chamber 47 while the other end of the first lubrication hole 56 faces to a sliding surface of the intermediate portion 41*a* of the shaft 41. Similarly, the bearing 43 has a second lubrication hole 57 which communicate at one of its opposite ends with the compression chamber 47 and, at the other end, with a friction point between the end portion 41*b* of the shaft 41 and the bearing 43 for a purpose described below. More specifically, the one end of the second lubrication hole 57 opens to the compression chamber 47 while the other end of the second lubrication hole 57 faces to a sliding surface of the end portion 41*b* of the shaft 41.

Figure 2:
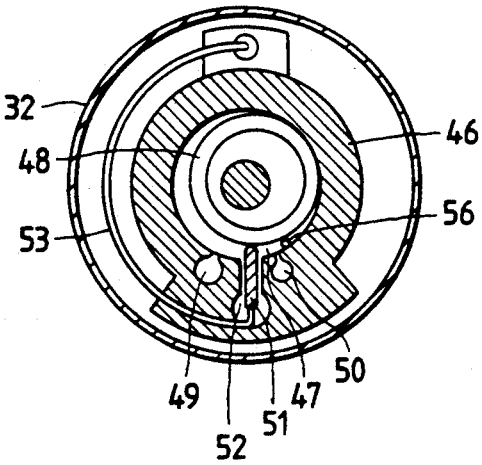
FIG. 2 is a cross-sectional view taken along line II—II of FIG. 1.

The refrigerant circulating pump 30 of the foregoing construction operates as follows. When the electric motor unit 36 is energized via the electrode assembly 35, the rotor 40 and the shaft 41 rotate clockwise in FIG. 2. The liquid refrigerant 55 returning from the air-conditioning system (not shown) is discharged from the intake pipe 37 into the closed container 31 in which the liquid refrigerant 55 is stirred and then drawn from the intake hole 49 into the compression chamber 47. The liquid refrigerant 55 trapped between the cylinder 46, the roller 48 and the vane 51 is progressively compressed within the compression chamber 47 as the roller 48 rolls on and along the inside surface of the compression chamber 47. When a peak of the eccentric portion 45 moves past the vane 55, the compressed liquid refrigerant 55 is discharged from the compression chamber 47 through the discharge hole 50 and thereafter fed through the discharge pipe 38 to the air-conditioning system. During that time, a very small quantity of liquid refrigerant bleeds out from the pressure equalizing hole 54 into the interior of the closed container 31 so as to maintain the interior of the closed container 31 at a high pressure.

Since the first and second small lubrication holes 56, 57 communicate at one end with the compression chamber 47, the liquid refrigerant 55 is fed under pressure through the lubrication holes 56, 57 to the friction points between the shaft 41 and the respective bearings 42, 43. Thus, the friction points are lubricated with the liquid refrigerant 55. With this lubrication, the refrigerant circulation pump is able to operate reliably for a long period of time without causing were of the shaft 41 and the bearings 42, 43.

Figure 3:
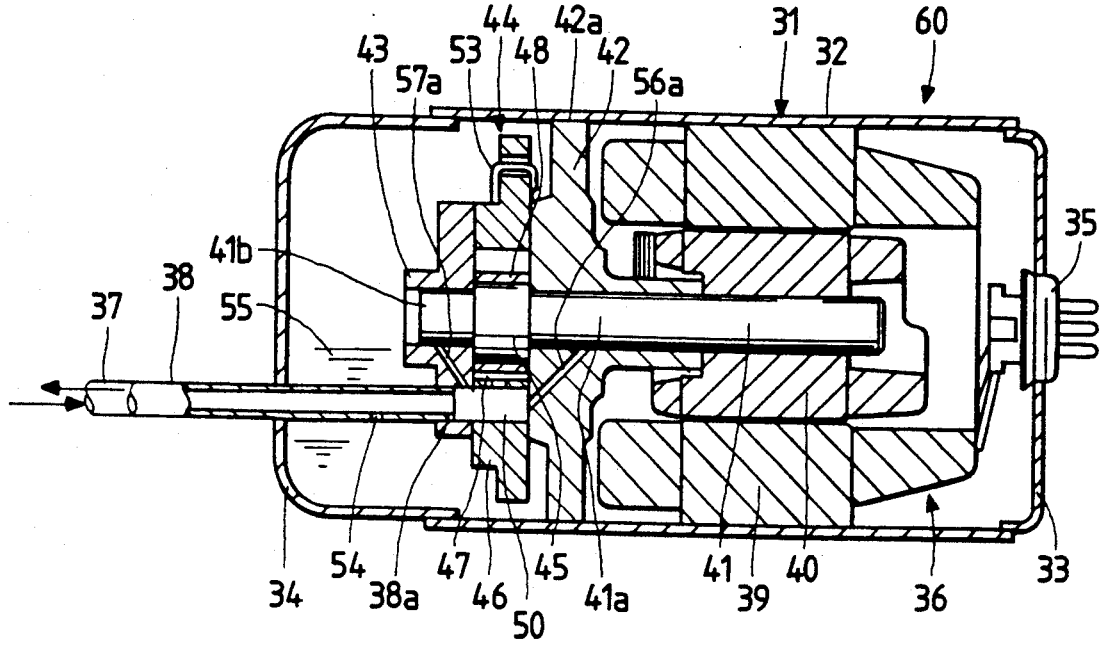
FIG. 3 is a cross-sectional view similar to FIG. 1, but showing another embodiment.

FIG. 3 shows a refrigerant circulation pump 60 according to another embodiment of this invention. The pump 60 differs from the pump 30 of the foregoing embodiment shown in FIGS. 1 and 2 in that first and second small lubrication holes 56*a* and 57*a* communicate at one end with the discharge hole 50 of the compression chamber 47 instead of the compression chamber 47.

During the operation of the refrigerant circulation pump 60, the compressed liquid refrigerant 55 is discharged from the compression chamber 47 into the discharge hole 50 and thence to the discharge pipe 38. In this instance, a portion of the compressed liquid refrigerant 55 is fed from the discharge hole 50 to friction points between the shaft 47 and the bearings 42, 43 via the lubrication holes 56*a*, 57*a*. The friction points (namely, sliding surfaces between the shaft 41 and the bearings 42, 43) are lubricated with the liquid refrigerant 55. With this lubrication of the sliding surfaces, the shaft 41 and the bearings 42, 43 are protected from wearing out and, hence, the refrigerant circulation pump 60 has a long service life.

Obviously, various minor changes and modifications of the present invention are possible in the light of the above teaching. It is therefore to be understood that within the scope of the appended claims the invention may be practiced otherwise than as specifically described.

What is claimed is:

1. A refrigerant circulation pump comprising:

(a) a closed container;

(b) an electric motor unit and a compressor unit that are disposed within said closed container, said compressor unit having a cylinder;

(c) a shaft driven by said electric motor unit to operate said compressor unit;

(d) bearing means rotatably supporting said shaft within said closed container, said bearing means and said cylinder jointly defining therebetween a compression chamber in which a liquid refrigerant is compressed during operation of said compressor unit; and (e) said bearing means having a small lubrication hole communicating, at one end, with said compression chamber and, at an opposite end, directly with a friction point between said shaft and said bearing means for lubricating said friction point with said liquid refrigerant, said opposite end of small lubrication hole facing a sliding surface of said shaft at said friction point.

2. A refrigerant circulation pump according to claim 1, wherein said shaft includes an eccentric portion disposed within said compression chamber, said compressor unit including a ring-shaped roller firmly fitted over said eccentric portion and slidably movable on and along an inside surface of said compression chamber as said shaft rotates, said bearing means including first and second bearings disposed on opposite sides of said eccentric portion of said shaft, said lubrication hole extending through each of said first and second bearings.

3. A refrigerant circulation pump comprising:

(a) a closed container;

(b) an electric motor unit and a compressor unit that are disposed within said closed container, said compressor unit having a cylinder;

(c) a shaft driven by said electric motor unit to operate said compressor unit;

(d) bearing means rotatably supporting said shaft within said closed container, said bearing means and said cylinder jointly defining therebetween a compression chamber in which a liquid refrigerant is compressed during operation of said compressor unit; and (e) said cylinder having a discharge hole communicating with said compression chamber for discharging the compressed liquid refrigerant therethrough from said compression chamber, said bearing means having a small lubrication hole communicating, at one end, with said discharge hole and, at an opposite end, directly with a friction point between said shaft and said bearing means for lubricating said friction point with said liquid refrigerant, said opposite end of said small lubrication hole facing a sliding surface of said shaft at said friction point.

4. A refrigerant circulation pump according to claim 3, wherein said shaft includes an eccentric portion disposed within said compression chamber, said compressor unit including a ring-shaped roller firmly fitted over said eccentric portion and slidably movable on and along an inside surface of said compression chamber as said shaft rotates, said bearing means including first and second bearings disposed on opposite sides of said eccentric portion of said shaft, said lubrication hole extending through each of said first and second bearings.

* * * * *